US006817892B2

(12) United States Patent
Sakai et al.

(10) Patent No.: US 6,817,892 B2
(45) Date of Patent: Nov. 16, 2004

(54) CONNECTOR ASSEMBLY AND AN ELECTRICAL CONNECTION STRUCTURE FOR A FLAT WIRE MEMBER

(75) Inventors: Yoshito Sakai, Nagoya (JP); Hiroki Hirai, Nagoya (JP); Kenji Okamura, Nagoya (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 206 days.

(21) Appl. No.: 10/006,204

(22) Filed: Dec. 10, 2001

(65) Prior Publication Data

US 2002/0076975 A1 Jun. 20, 2002

(30) Foreign Application Priority Data

Dec. 15, 2000 (JP) ..... 2000-382403

(51) Int. Cl.[7] ..... H01R 9/07
(52) U.S. Cl. ..... 439/495; 439/498; 361/735
(58) Field of Search ..... 439/77, 495, 496, 439/498, 631, 928; 361/735

(56) References Cited

U.S. PATENT DOCUMENTS 3,188,601 A 6/1965 De Tar
3,366,919 A * 1/1968 Gammel et al. ..... 439/495
3,740,698 A * 6/1973 Jerominek ..... 439/61
4,558,916 A 12/1985 Hehl
4,915,650 A 4/1990 Daly et al.
5,007,858 A * 4/1991 Daly et al. ..... 439/498
5,975,934 A * 11/1999 Ichimura ..... 439/260
5,984,704 A * 11/1999 Hashiguchi ..... 439/260
6,068,493 A * 5/2000 Langridge ..... 439/77
6,250,966 B1 * 6/2001 Hashimoto et al. ..... 439/631

FOREIGN PATENT DOCUMENTS

EP 0 694 927 A1 1/1996
JP A 11-329619 11/1999
JP A 11-329620 11/1999

* cited by examiner

*Primary Examiner*—Thanh-Tam Lee
(74) *Attorney, Agent, or Firm*—Oliff & Berridge PLC

(57) ABSTRACT

As a structure for electrically connecting conductors of a flat cable (flat wire member) with a circuit board, an end of the flat cable is split into split pieces, and connectors (second connectors) are mounted at the ends of the respective split pieces. A connector (first connector) provided with two connecting portions for the connectors are mounted on the circuit board. When the respective connectors mounted on the flat cable are connected with the connector, the respective conductors of the split pieces are brought into contact with terminals accommodated in the connector. The flat cable or the flat wire member can be easily and securely connected.

4 Claims, 11 Drawing Sheets

CONNECTOR ASSEMBLY AND AN ELECTRICAL CONNECTION STRUCTURE FOR A FLAT WIRE MEMBER

BACKGROUND OF THE INVENTION

This invention relates to a connector assembly for electrically connecting a flat cable, a ribbon wire, FPC (flexible printed circuit) or like flat wire member, in which flat rectangular conductors are arrayed side by side, with a circuit board or the like, and also to an electrical connection structure for the flat wire member.

As a mounting structure of audio equipments and the like, for example, on an instrument panel of an automotive vehicle, it has been a general practice to vertically arrange a CD player, a MD (mini-disc) player, etc. and electrically connect circuit boards of the respective players by flat wire members such as flat cables.

Specifically, while a connector for circuit board is mounted on the circuit board of each player, conductors are exposed at an end of the flat cable; a mating connector connectable with the connector for circuit board is mounted on the exposed end of the flat cable; and the mating connector is fitted into the connector for circuit board to bring the respective conductors of the flat cable into contact with the respective terminals accommodated in the connector for circuit board, thereby electrically connecting the flat cable and the circuit board of each player.

As the above audio equipments to be installed in automotive vehicles have come to possess more functions in recent years, the number of the conductors of the flat cable has been on the increase.

Such an increase in the number of the conductors has become one of factors which increase a frictional resistance with the terminals during a flat cable connecting operation, thereby making the operation difficult and causing a connection error and the like. Accordingly, it is desired to solve such difficulties of the connecting operation. Even if such a problem is solved, production costs increase if the connector assembly comes to have a more complicated construction and the number of parts is excessively increased. Thus, this point needs to be considered.

SUMMARY OF THE INVENTION

It is an object of the invention to provide a connector assembly and an electrical connection structure which are free from the problems residing in the prior art.

According to an aspect of the invention, a connector assembly for a flat wire member comprises a first connector for accommodating terminals, and a plurality of second connectors to be mounted on an end of a common flat wire member. The first connector includes a plurality of connecting portions individually connectable with the plurality of second connectors. The terminals are so accommodated in the first connector as to be brought into contact with conductors of the flat wire member connected with the first connector via the respective second connectors connected with the connecting portions.

These and other objects, features and advantages of the present invention will become more apparent upon a reading of the following detailed description and accompanying drawings.

DETAILED DESCRIPTION OF THE PREFERRED EMBODIMENTS OF THE PRESENT INVENTION

Figure 1:
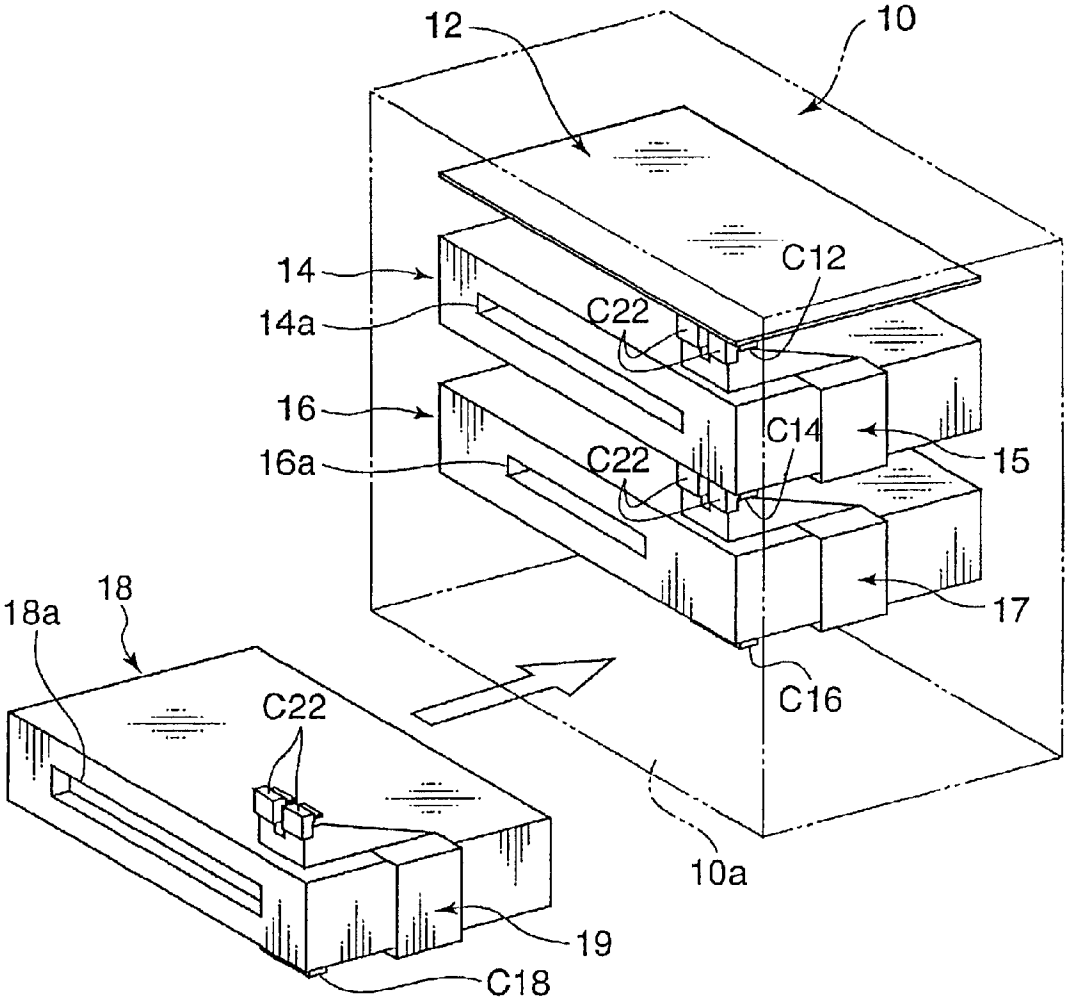
FIG. 1 is a perspective view showing an audio unit to be installed in an automotive vehicle to which a connector assembly for a flat wire member according to an embodiment of the invention.

One embodiment of the invention is described with reference to the accompanying drawings. FIG. 1 schematically shows an audio unit to be installed in an automotive vehicle in an embodiment of the invention. In FIG. 1, identified by 10 is a casing having openings at its front and rear sides, and a main circuit board 12 for centrally controlling this unit, a CD player 14, a MD (mini-disc) player and a CS (cassette) player 18 are accommodated and fixed in this order from above inside this casing 10.

The respective players 14, 16, 18 have insertion openings 14*a*, 16*a*, 18*a* for corresponding media, and are accommodated in the casing 10 such that these insertion openings 14*a*, 16*a*, 18*a* face a front opening 10*a* of the casing 10. These players 14, 16, 18 are assembled in a passenger's compartment with the insertion openings 14*a*, 16*a*, 18*a* thereof faced toward the passenger's compartment by mounting the casing 10 on an instrument panel from behind. Thus, the media can be inserted and taken out in the passenger's compartment. Though not shown, an operation panel provided with operable members for operating the respective players 14, 16, 18 is mounted on the front side of the casing 10.

The respective players 14, 16, 18 are provided with flat wire members 15, 17, 19 for electrical connection (flat cables in this embodiment: hereinafter referred to as cables 15, 17, 19) and connectors C14, C16, C18 (first connectors). By connecting the cables 15, 17, 19 of the players 14, 16, 18 with the main circuit board 12 or the connectors C12, C14, C16 of the players 14, 16, 18 located vertically adjacent with the main circuit board 12 and the players 14, 16, 18 accommodated while being vertically arranged as described above, the players 14, 16, 18 are electrically connected in a chain with the main circuit board 12.

The respective connectors C14, C16, C18 of the players 14, 16, 18 and the respective cables 15, 17, 19 have the same structure, so that, even if the players 14, 16, 18 are rearranged or any of them is omitted, they are connectable with each other. Hereinafter, these structures are described, taking the CD player 14 as an example.

Figure 2:
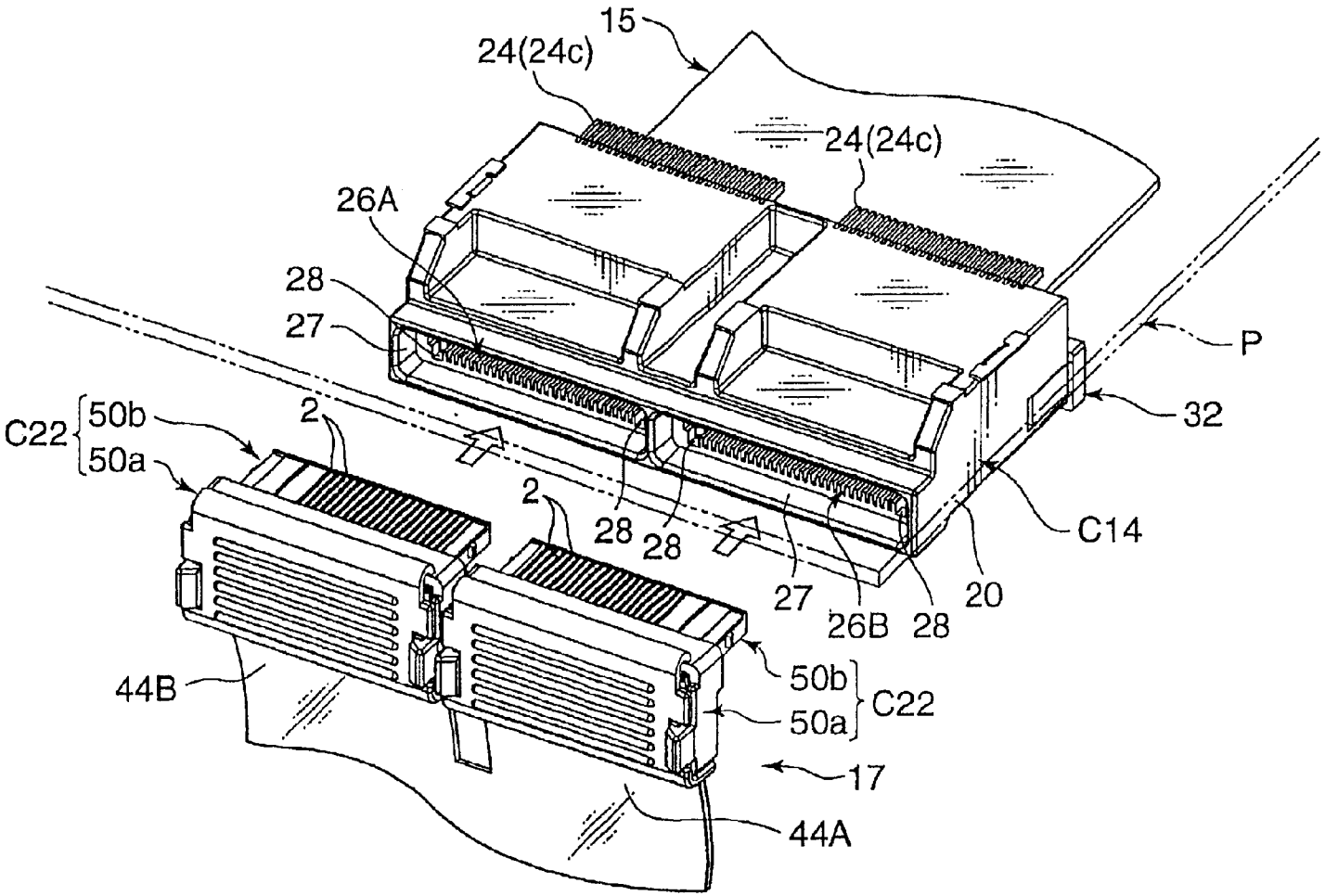
FIG. 2 is a perspective view showing a connector (first connector) to be mounted on a circuit board of a CD player and a connector (second connector) of a flat cable (flat wire member) to be connected with the first connector.
Figure 3:
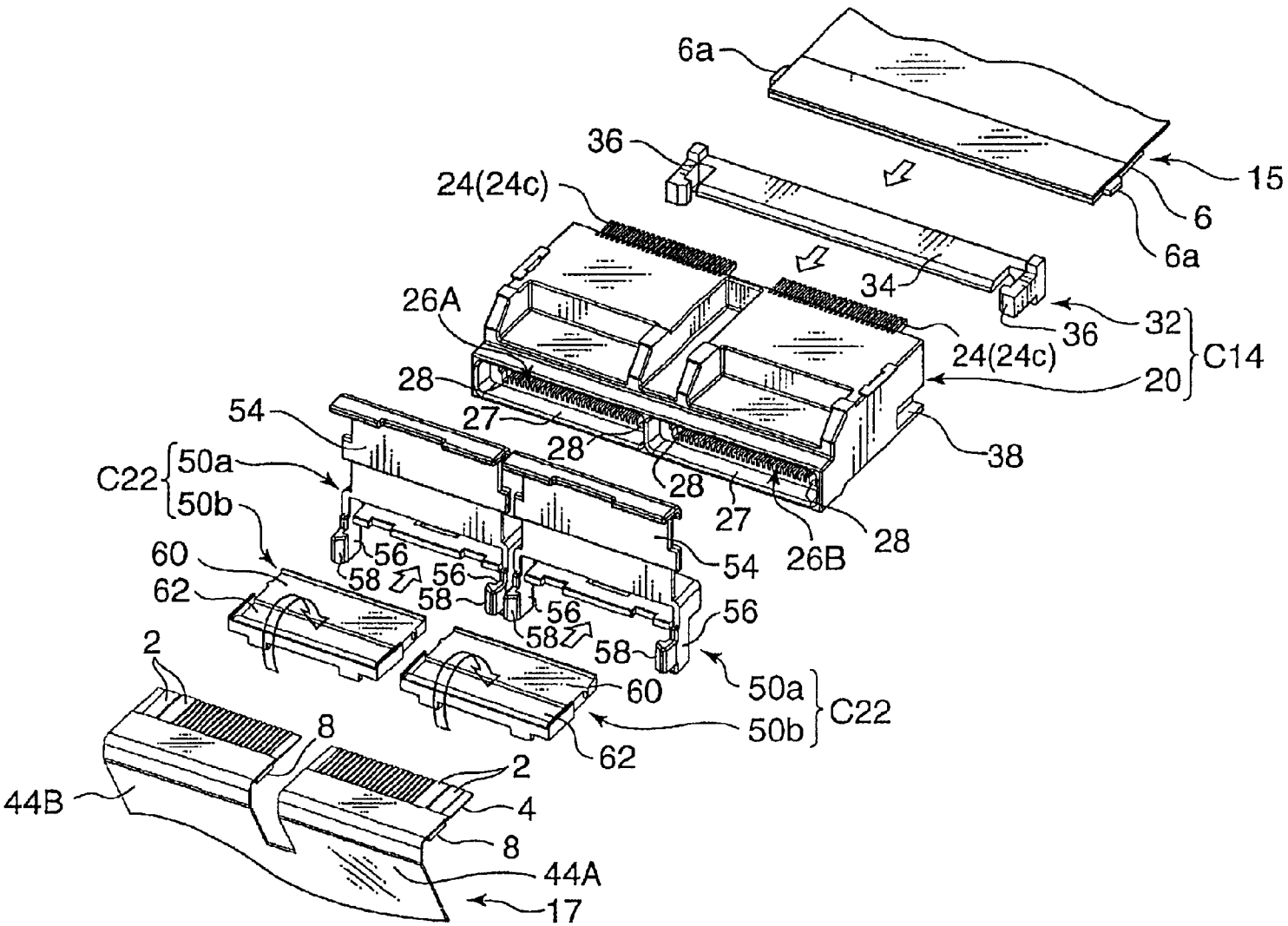
FIG. 3 is an exploded perspective view showing the first and second connectors.
Figure 4A:
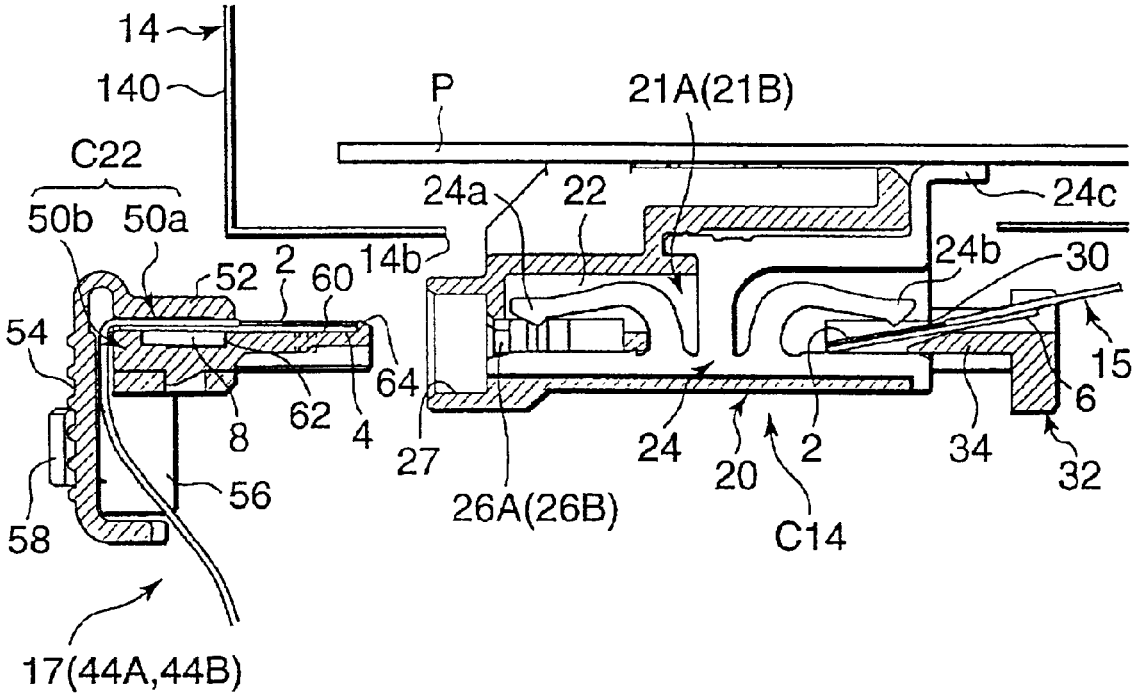
FIGS. 4A and 4B are sectional views showing structures of the first and second connectors prior to and at an intermediate stage of connection of the two connectors, respectively.

As shown in FIGS. 2, 3 and 4A, the CD player 14 has a circuit board P inside its casing 140 (see FIG. 4A), and the connector C14 is provided on the lower surface of the circuit board P. The connector C14 is a connector for circuit board, is secured to the circuit board P by being mounted and is exposed to outside at the bottom side of the CD player 14 via an opening 14*b* formed in the casing 140.

The connector C14 is formed at its front side with a section to be connected with the cable 17 of the MD player 16, and the cable 15 of the CD player 14 is fixedly inserted at its rear side.

Figure 6:
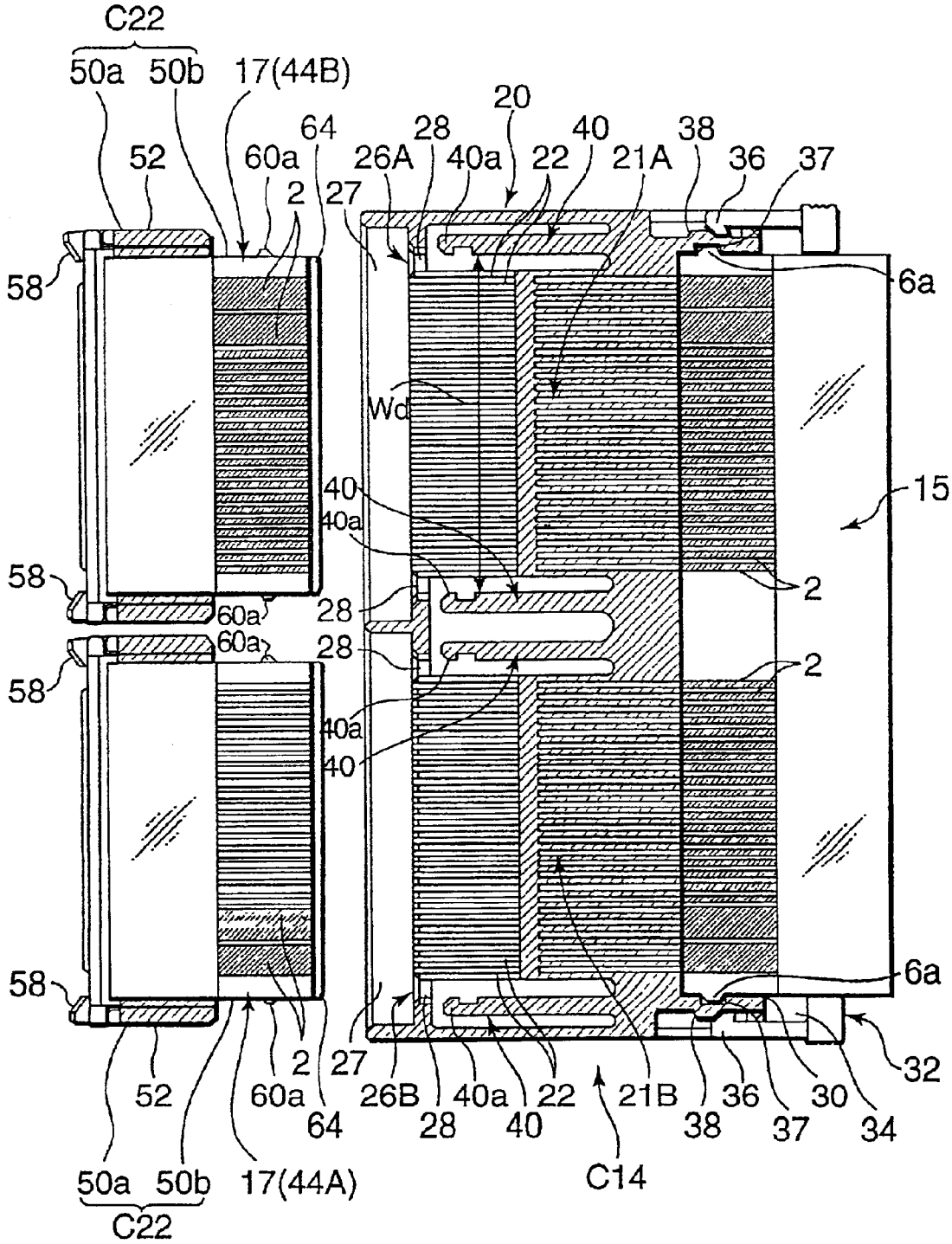
FIG. 6 is a sectional view showing the structures of the first and second connectors.

More specifically, the connector C14 has a female housing 20 narrow in the widthwise direction of the CD player 14 (direction normal to the plane of FIG. 4A: hereinafter referred to merely as widthwise direction). This housing 20 is formed with two connection sections 21A, 21B separated along the widthwise direction (vertical direction in FIG. 6) as shown in FIG. 6.

A plurality of cavities 22 are formed side by side along the widthwise direction in each connection section 21A, 21B, and terminals 24 (see FIG. 4A; not shown in FIG. 6) are accommodated in the respective cavities 22. Each terminal 24 is comprised of resiliently deformable pieces 24*a*, 24*b* for connection which extend forward and backward from a middle portion of the cavity 22 and are vertically resiliently displaceable, and a leg portion 24*c* extending obliquely upward to the back from the middle between the resiliently deformable pieces 24*a* 24*b*. Each terminal 24 is electrically connected with a circuit on the circuit board by the leg portion 24*c* thereof being soldered to a land or the like (not shown) on the circuit board P.

In the front surface of the housing 20, insertion openings 26A, 26B for the cable (cable 17 of the MD player 16) corresponding to the respective connection sections 21A, 21B are independently formed. During connection of the cable 17, connectors C22 of the cable 17 to be described later are inserted into the housing 20 through these insertion openings 26A, 26B to bring the respective conductors of the cable 17 into contact with the front resiliently deformable pieces 24*a* of the respective terminals 24. Tubular hoods 27 are formed around the respective insertion openings 26A, 26B, and the connectors C22 of the cable 17 are fitted into these hoods 27 during connection of the cable 17. In other words, the connecting portions according to the present invention are formed by the insertion openings 26A, 26B, the hoods 27, etc. Further, guide grooves 28 for guiding the connectors C22 of the cable 17 are formed at the opposite ends of the respective insertion openings 26A, 26B.

On the other hand, the rear surface of the housing 20 is formed with an insertion opening 30 narrow in widthwise direction and common to the both connection sections 21A, 21B, and a slider 32 is insertably and detachably supported in this insertion opening 30.

As shown in FIG. 3, the slider 32 is a narrow member extending in the widthwise direction of the housing 20, and includes a tongue 34 extending in its longitudinal direction and fixing hooks 36 at its opposite ends. The slider 32 is inserted into the housing 20 through the insertion opening 30 together with the cable 15 while being placed on the cable 15, and is attached to the housing 20 by engaging the hooks 36 with projections 38 formed on the side walls of the housing 20, thereby fixing the cable 15 inserted into the connector C14. In other words, the insertion portion according to the present invention is formed by the insertion opening 30 and the like. A method for fixing the cable 15 is described in detail later.

Inside the housing 20 of the connector C14, a pair of locking pieces 40 resiliently deformable in widthwise direction are provided near the respective insertion openings 26A, 26B and at the opposite outer sides of the respective connection sections 21A, 21B as shown in FIG. 6. Each locking piece 40 is provided with a hook 40*a* at its leading end (left end in FIG. 6). When the connectors C22 of the cable 17 are inserted into the housing 20 through the respective insertion openings 26A, 26B, the hooks 40*a* are engaged with locking portions 60*a* of the connectors C22 to be described later.

Figure 7:
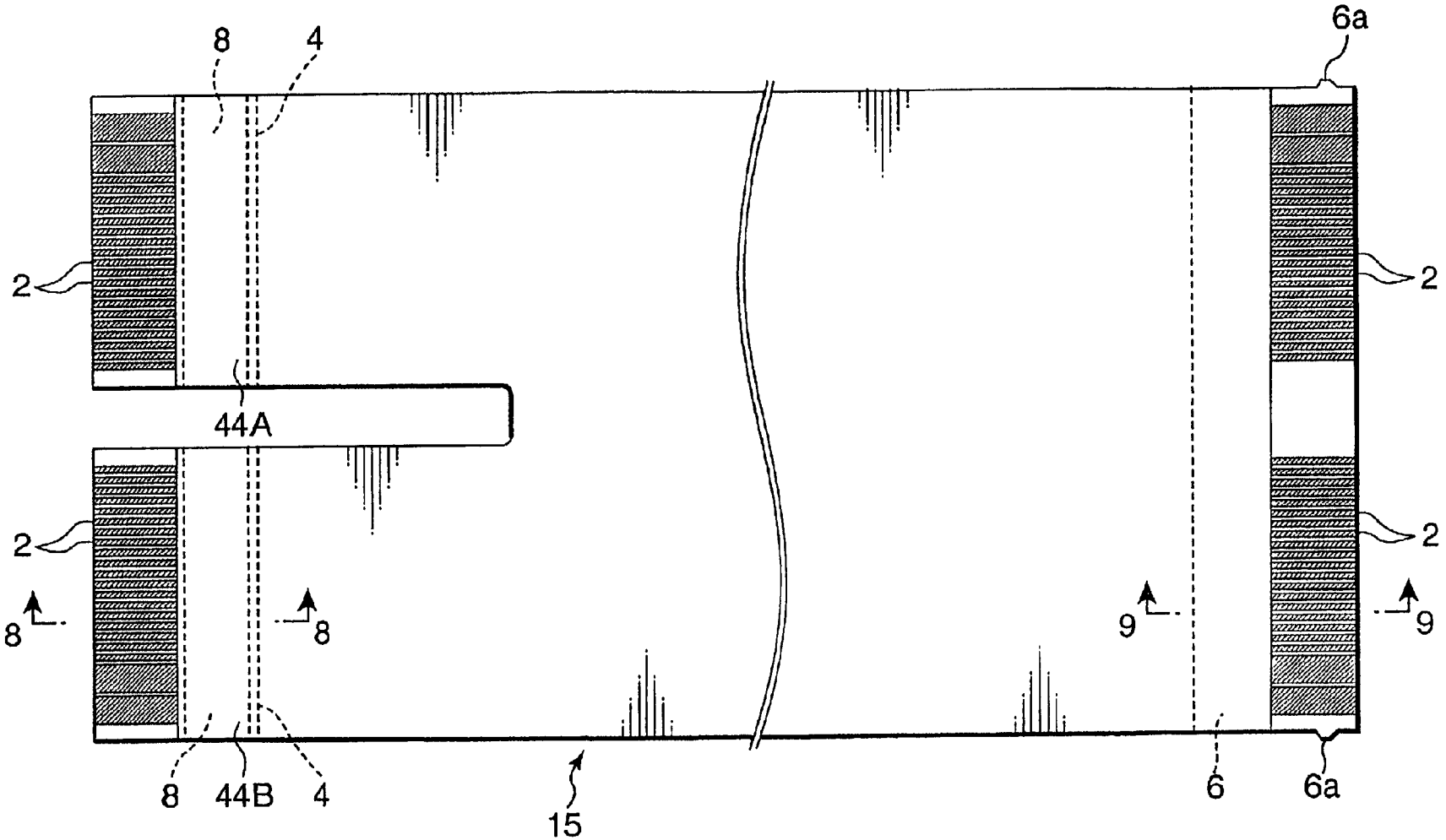
FIG. 7 is a plan view showing a structure of the flat cable.
Figure 8:
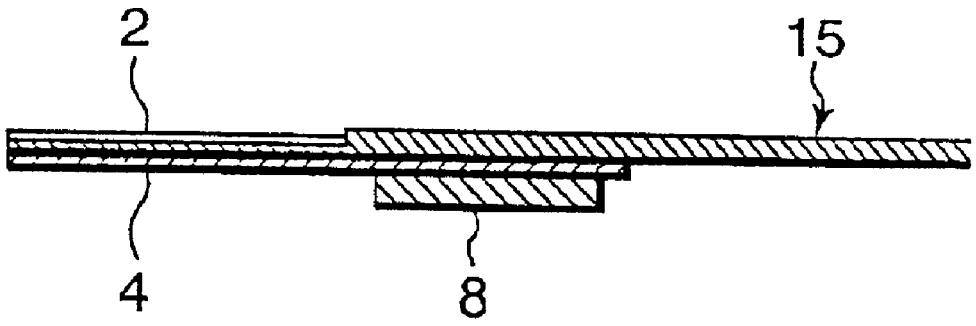
FIG. 8 is a sectional view taken along the line 8—8 of FIG. 7 showing the structure of the flat cable.
Figure 9:
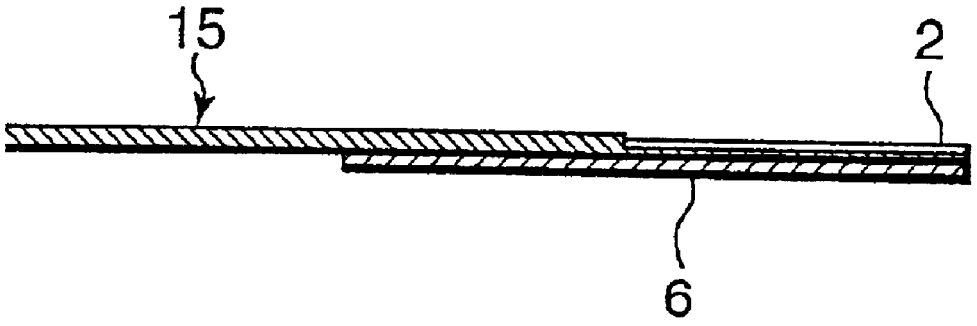
FIG. 9 is a sectional view taken along the line 9—9 of FIG. 7 showing the structure of the flat cable.

As shown in FIGS. 7 to 9, the cable 15 takes a forked structure by cutting away a middle portion (widthwise middle portion) of one end portion (left end portion of FIG. 7) to split this end portion into split pieces 44A, 44B. Ends of the cable 15 (i.e., end where the split pieces 44A, 44B are located and an end opposite therefrom) are processed to expose conductors 2, and reinforcing plates 4, 6 for restricting the deformation of the cable end portions are secured to the rear surfaces of these end portions. Positioning plates 8 are additionally secured to the reinforcing plates 4 of the split pieces 44A, 44B at a position more backward (rightward in FIG. 8) than the exposed sections of the conductors 2.

Figure 4B:
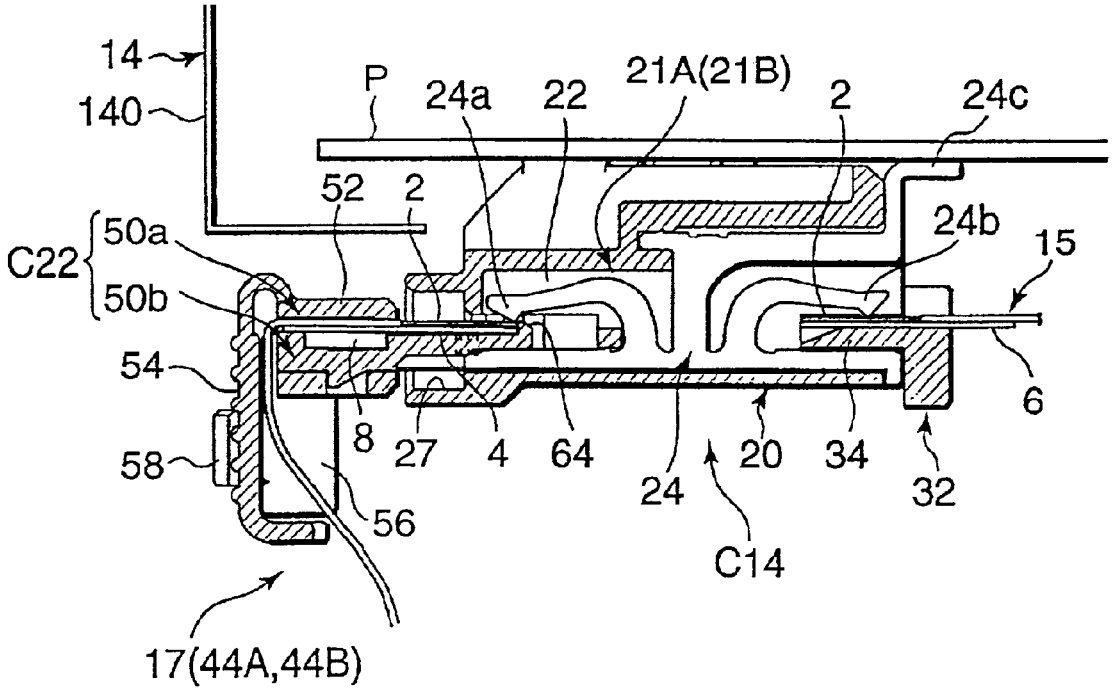

The cable 15 is connected with and fixed to the connector C14 with the end thereof opposite from the split pieces 44A, 44B inserted into the housing 20 through the insertion opening 30 in the rear surface of the connector C14. Specifically, after the end of the cable 15 is loosely fitted into the housing 20 through the insertion opening 30 in the rear surface as shown in FIG. 4A, the slider 32 is inserted into the housing 20 through the insertion opening 30 as shown in FIG. 4B. Then, the end of the cable 15 is pushed up by the tongue 34 of the slider 32, thereby fixing the conductors 2 of the cable 15 while holding them in contact with the deformable pieces 24*b* of the terminals 24 accommodated in the respective connection sections 21A, 21B. The respective conductors 2 of the cable 15 are connected with the circuits of the circuit board P via the terminals 24 by the contact thereof with the terminals 24. Partial locking projections 6*a* are formed at the opposite widthwise ends of the reinforcing plate 6 of the cable 15 as shown in FIG. 7. When the end of the cable 15 is loosely inserted into the housing 20 through the insertion opening 30 (state shown in FIG. 4A), the cable 15 can be partly locked in the housing 20 by engaging the projections 6*a* with recesses 37 formed in the inner surfaces of the side walls of the housing 20 until the slider 32 is inserted.

Although the conductors 2 are present at the middle portion (widthwise middle portion) of the cable 15 according to this embodiment, this middle portion of the cable 15 is a dead space over its longitudinal direction since the middle portion at one end portion is cut away to form the split pieces 44A, 44B as described above. Thus, the conductors 2 at the middle portion are also omitted as shown in FIG. 7 at the end of the cable 15 to be fixed to the connector C14 (i.e., end opposite from the split pieces 44A, 44B).

On the other hand, the connectors C22 (second connectors) are mounted on the ends of the respective split pieces 44A, 44B of the cable 15 as shown in FIGS. 2 and 3. Although the connectors C22 are mounted on the cable 17 in FIGS. 2 and 3, since the cables 15, 17 have a common structure as described above, the following description is given with reference to FIGS. 2 and 3 for the sake of convenience.

Figure 10A:
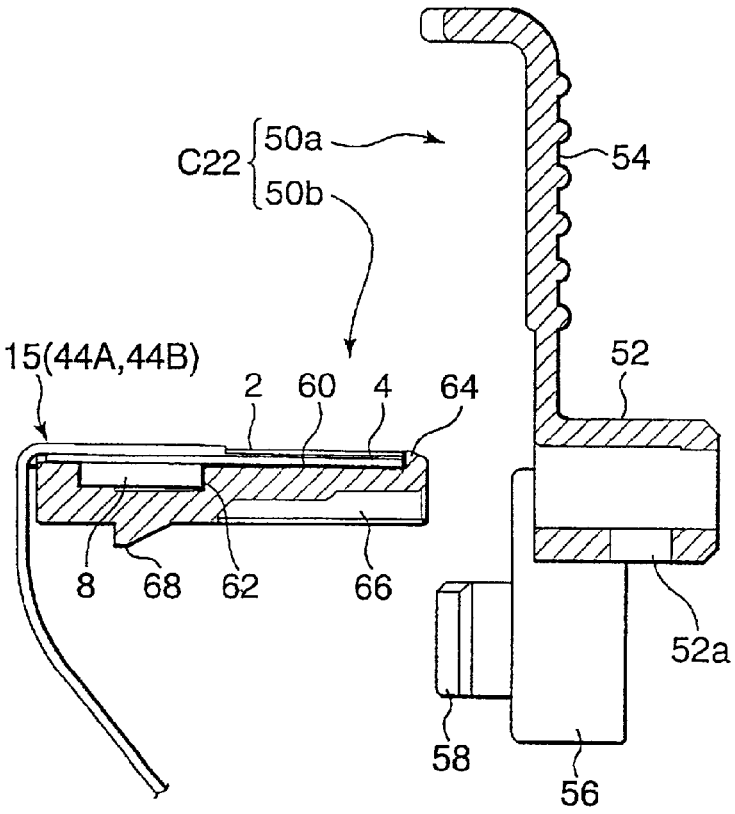
FIGS. 10A and 10B are sectional views showing the structure of the second connector before and after being connected (assembled) with the flat cable, respectively.

Each connector C22 is comprised of a housing 50*a* and the holder 50*b* as shown in FIGS. 3 and 10A, and is mountable on the end of the split piece 44A (44B) by inserting the holder 50*b* into the housing 50*a* while placing the holder 50*b* on the split piece 44A (44B).

Specifically, the housing 50*a* has a tubular shell portion 52 which is narrow in widthwise direction and into which the holder 50*b* and the like are insertable. This shell portion 52 is provided with a vertically foldable (bendable) locking piece 54 at an upper part (left upper part in FIG. 10A) of an insertion opening of the holder 50*b* at its one end. Further, a pair of leg portions 56 including hooks 58 engageable with the locking piece 54 are provided at the opposite widthwise ends of the shell portion 52.

Figure 11:
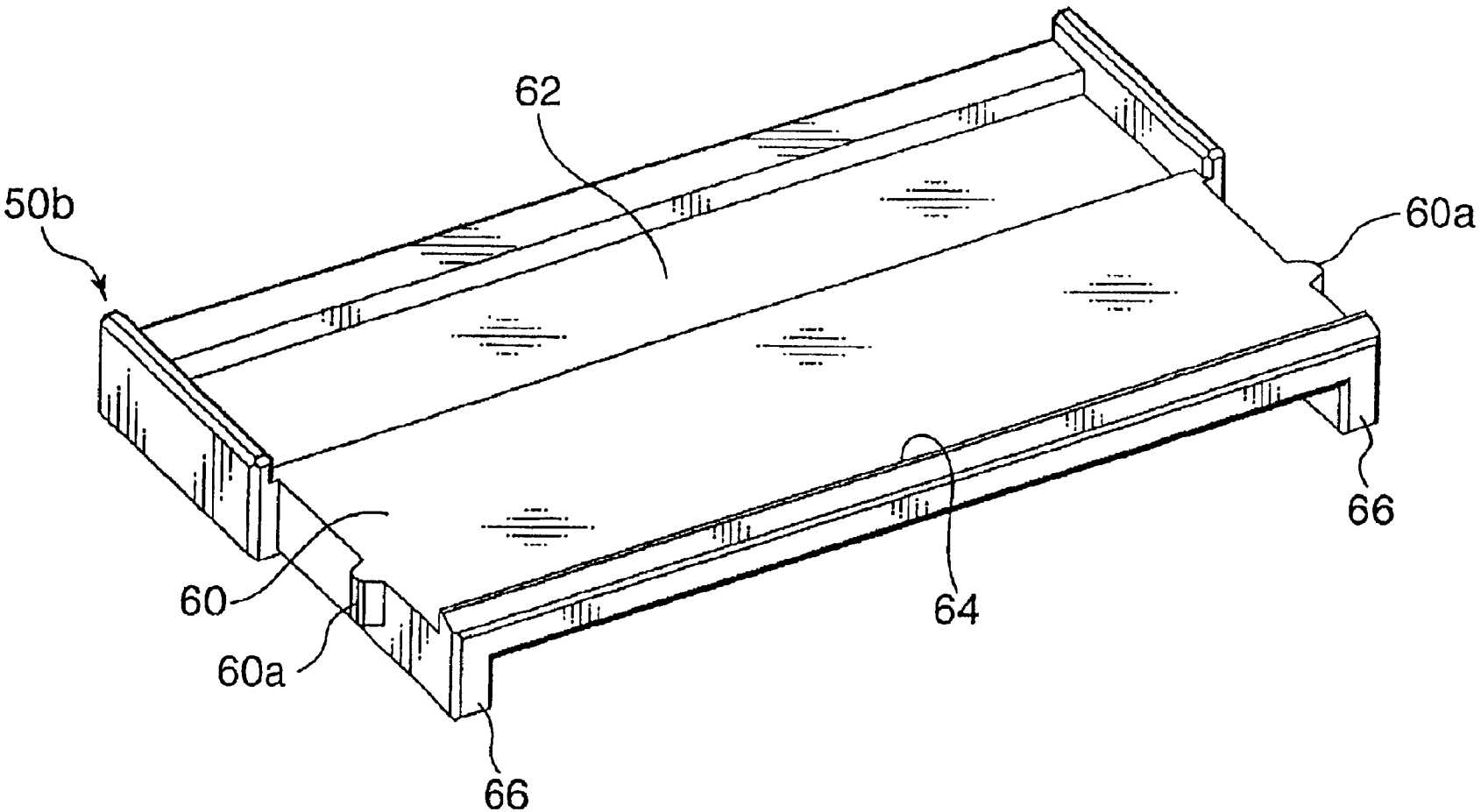
FIG. 11 is a perspective view of a holder forming the second connector.

On the other hand, the holder 50*b* is a plate member having a flat alignment surface 60 on top as shown in FIG. 11, and is placed on the rear surface (reinforcing plate 4) of the split piece 44A (44B) via the alignment surface 60. A positioning recess 62 is formed at a rear part (left part in FIG. 10A) of the alignment surface 60 in order to restrict a displacement of the split piece 44A (44B) and the holder 50*b* by fitting the positioning plate 8 of the split piece 44A (44B) into the recess 62. Further, an interference preventing rib 64 for protecting the conductors 2 of the cable 15 from rolling up or the like caused by interference during connection is formed at the leading end (right end in FIG. 10A) of the holder 50*b*.

The connector C22 is mounted on the split piece 44A (44B) as follows. The holder 50*b* is placed on the rear surface of the split piece 44A (44B) via the alignment surface 60 as shown in FIG. 10A, and the split piece 44A (44B) is inserted together with the holder 50*b* into the shell portion 52 of the housing 50*a* from its leading end (i.e., from the rib 64 of the holder 50*b*) in this state. Then, the locking piece 54 is so bend as to close the insertion opening (left opening of the shell portion 52 in FIG. 10A) of the holder 50*b*, and is locked so as not to return to its initial position by being pushed between the two hooks 58. In this way, the connector C22 is mounted on the split piece 44A (44B).

Figure 10B:
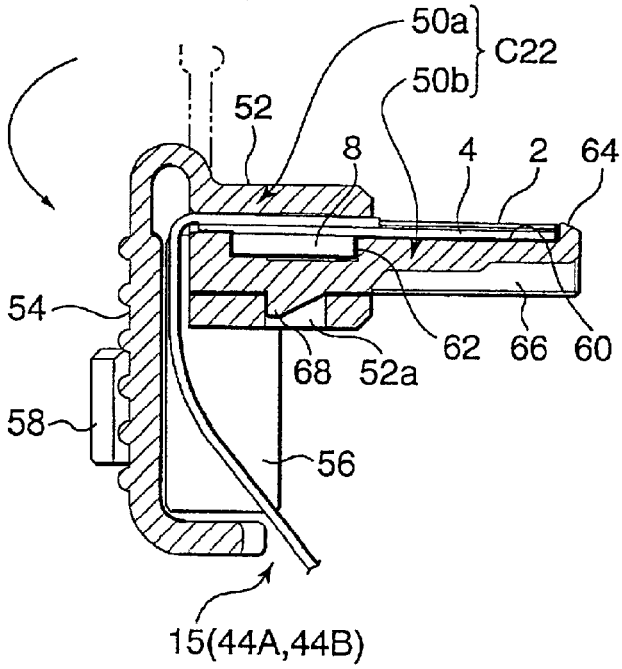

With the connector C22 mounted on the split piece 44A (44B), the exposed sections of the conductors 2 at the end of the split piece 44A (44B) are supported together with the holder 50*b* while projecting from the opposite side of the shell portion 52 of the housing 50*a* as shown in FIG. 10B. Further, as shown in FIG. 10B, a hook 68 formed on the rear surface of the holder 50*b* is engaged with a locking hole 52*a* formed in the inner bottom wall of the shell portion 52 of the housing 50*a*, with the result that the holder 50*b* is doubly locked in the housing 50*a* in cooperation with the locking piece 54 so as not to come out of the housing 50*a*.

As shown in FIG. 11, the locking portions 60*a* project at the opposite widthwise ends of the holder 50*b* of the connector C22, and a pair of guides 66 made of elongated projections in forward and backward directions (transverse direction in FIG. 10A) are provided at the opposite widthwise ends of the rear surface of the holder 50*b*.

The structures of the connector C14, the cable 15 and the like are described above, taking the CD player 14 as an example. The connectors C16, C18, the cable 17, 19 and the like of the other players 16, 18 have the same structures as the connector C14 and the cable 15 of the CD player 14. Further, the connector C12 to be mounted on the main circuit board 12 also has the same structure as the connector C14 of the CD player 14.

The cables 15, 17, 19 of the respective players 14, 16, 18 are bent as shown in FIG. 1, and are drawn to the tops of the front surfaces of the players 14, 16, 18 while being laid along the side surfaces of the players 14, 16, 18.

The audio unit as above is assembled as follows. First, the main circuit board 12, the CD player 14, the MD player 16 and the CS player 18 are fixed in a specified order in the casing 10, and the cables 15, 17, 19 of the respective players 14, 16, 18 are connected with the players or the like located right above. Specifically, the cable 15 of the CD player 14 is connected with the connector C12 of the main circuit board 12; the cable 17 of the MD player 16 with the connector C14 of the CD player 14; and the cable 19 of the CS player 18 with the connector C16 of the MD player 16.

Figure 12A:
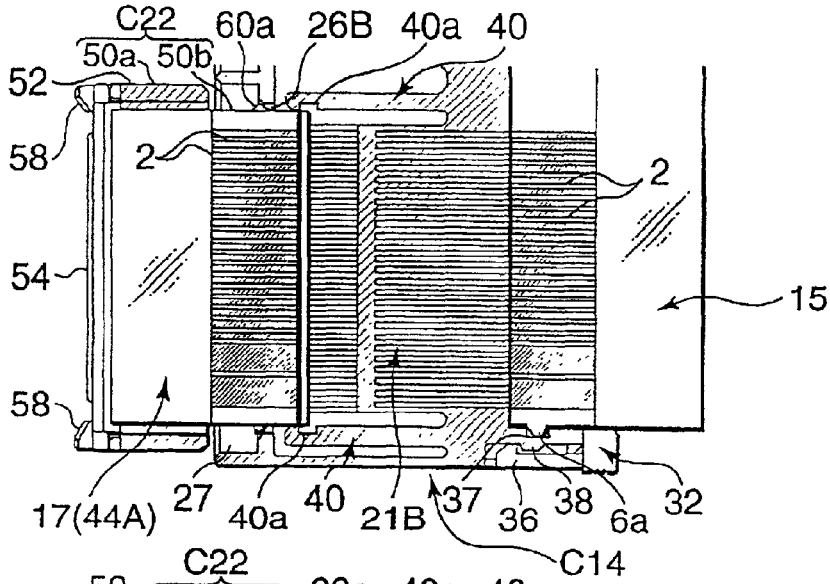
FIGS. 12A, 12B and 12C are sectional views showing the structures of the first and second connectors, corresponding to FIGS. 4B, 5A and 5B, respectively.
Figure 12B:
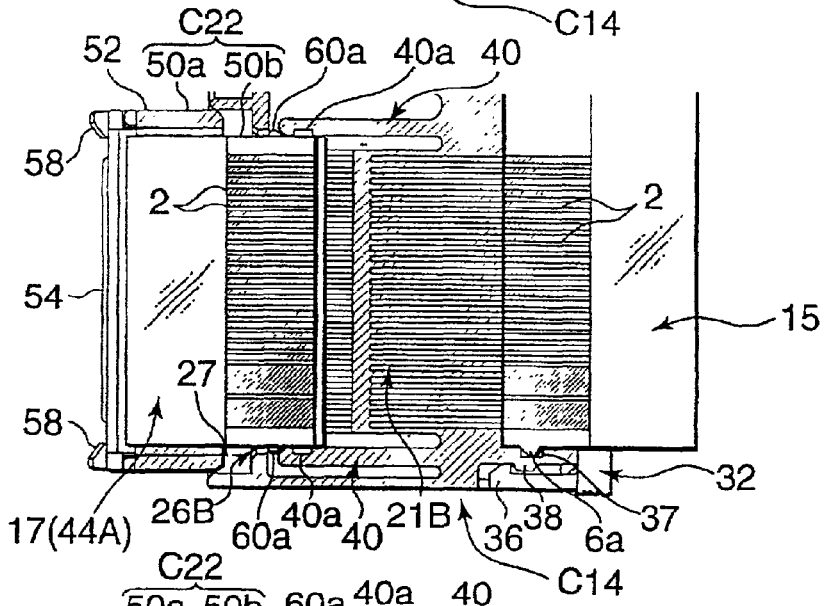

For example, in the case of connecting the cable 17 of the MD player 16 with the connector C14 of the CD player 14, the respective connectors C22 of the cable 17 are opposed to the respective insertion openings 26A, 26B of the connector C14, and the projecting portions of the holders 50*b* of the respective connectors C22 are inserted into the insertion openings 26A, 26B from their leading ends as shown in FIGS. 4B and 12A. At this time, the connectors C22 are inserted into the insertion openings 26A, 26B while the guides 66 of the holders 50*b* are guided along the guide grooves 28 formed in the insertion openings 26A, 26B.

Figure 5A:
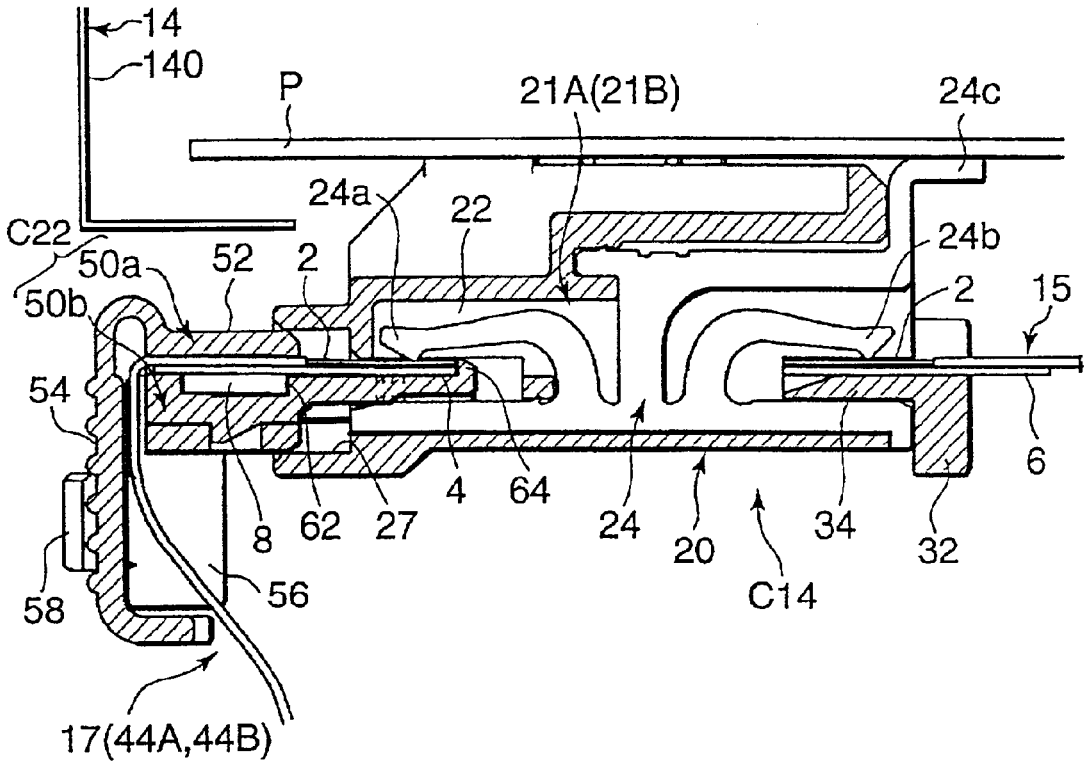
FIGS. 5A and 5B are sectional views showing the structures of the first and second connectors at an intermediate stage of and after connection of the two connectors, respectively.
Figure 5B:
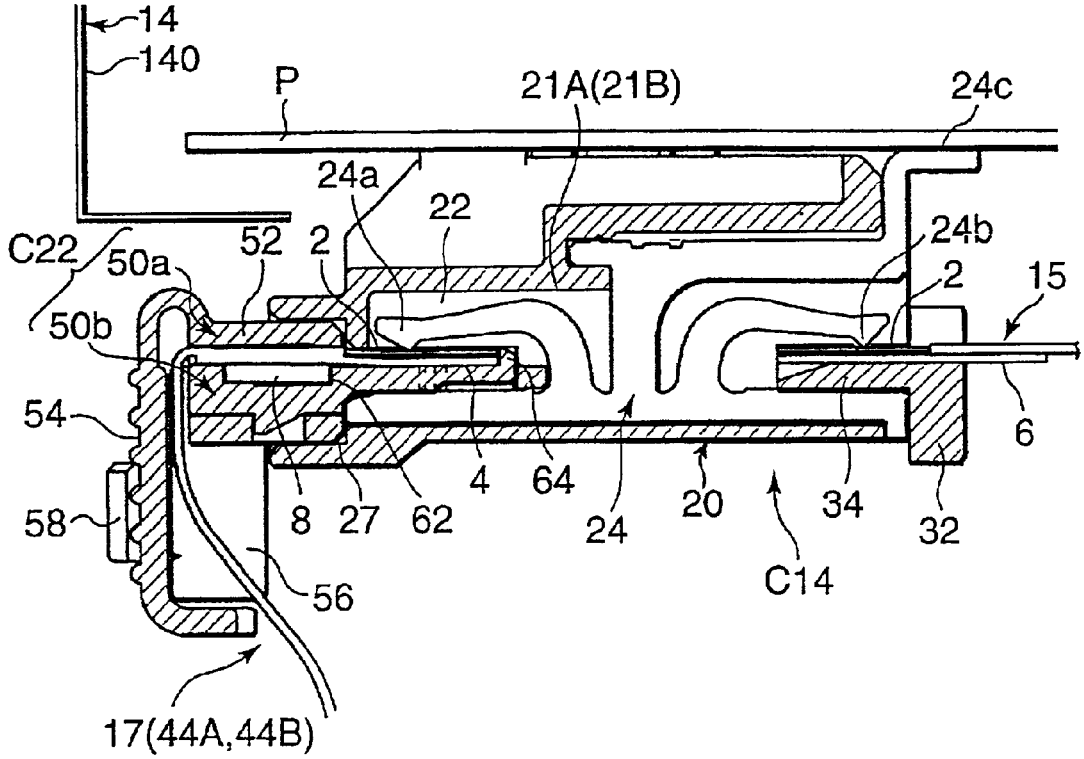
Figure 12C:
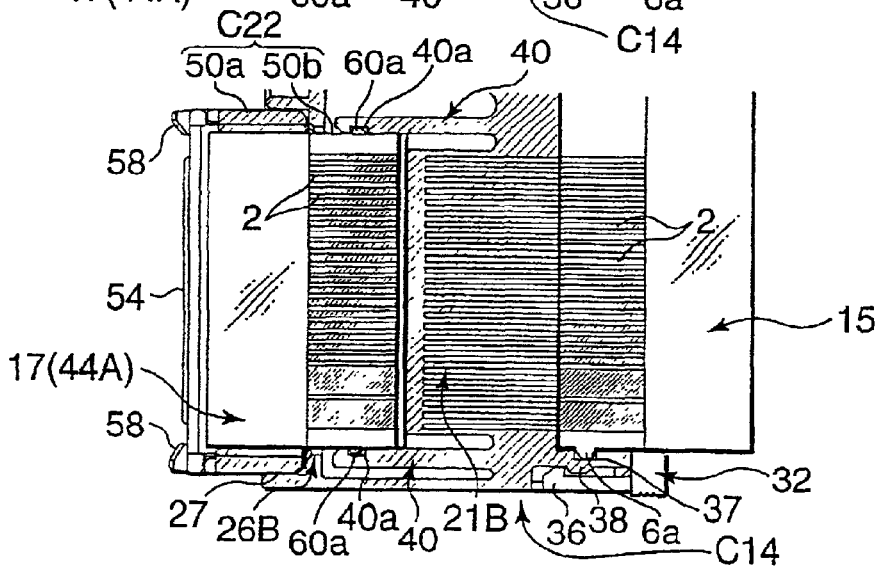

In this way, the housings 50*a* (shell portions 52) of the respective connectors C22 are fitted into the hoods 27 of the connector C14, i.e., a state shown in FIGS. 5A and 12A changes to a state shown in FIGS. 5B and 12C. As the connectors C22 are inserted, a pair of locking pieces 40 in the connector C14 are pushed to separate wider by the locking portions 60*a* formed in the holders 50*b*. When the holders 50*b* are inserted to the back ends of the connectors C22, the hooks 40*a* of the respective locking pieces 40 are engaged with the locking portions 60*a* of the holders 50*b*, with the result that the connectors C22 are locked into the connector C14. The locking portion 60*a* of the holder 50*b* is formed into such a substantially trapezoidal shape in plan view which is tapered from its base end toward its leading end. Accordingly, this locked state is a so-called "semi-locked" state and, when being pulled in a withdrawal direction with a specified force or larger, the connector C22 can be detached from the connector C14 while being unlocked.

When the connectors C22 are connected with the connector C14, the exposed sections of the conductors 2 of the cable 17 are inserted into the connection sections 21A, 21B of the connector C14 together with the holders 50*b*, thereby bringing the deformable pieces 24*a* of the respective terminals 24 into contact with the respective conductors 2 of the cable 17. By this contact, the respective conductors 2 of the cable 17 are connected with the circuits of the circuit board P of the CD player 14 via the terminals 24, and corresponding pairs of the conductors 2 of the cable 15 of the CD player 14 connected with the rear surface of the connector C14 and those of the cable 17 are connected via the terminals 24.

The respective players 14, 16, 18 can be connected with the main circuit board 12 in a chain by connecting the cables 15, 17, 19 with the respective players located vertically adjacent to each other.

As described above, in this audio unit, the main circuit board 12 and the respective players 14, 16, 18 vertically arrayed are electrically connected in a chain by the cables 15, 17, 19 provided in the players 14, 16, 18. The ends of the cables 15, 17, 19 of the players 14, 16, 18 take a forked structure (split into the split pieces 44A, 44B), and the connectors C22 are mounted on the splits pieces 44A, 44B. On the other hand, the connectors C12, C14, C16, C18 each having two connection sections 21A, 21B corresponding to the connectors C22 are provided as mating connectors. Thus, even in the case that the cables 15, 17, 19 have quite a number of conductors 2, they can be easily and securely connected with the main circuit board 12 and the players 14, 16, 18. Specifically, according to this structure, the connecting operation for the cables 15, 17, 19 can be split: after one connector C22 of the cable 15, 17 or 19 is connected, the other connector C22 thereof is connected. Thus, an operation force necessary for one connecting operation of the connector C22 can be reduced. Therefore, even in the case that the cables 15, 17, 19 have quite a number of conductors 2, they can be easily and securely connected by splitting the connecting operation.

Accordingly, as compared to the general prior art connection structure in which one connector is mounted on an end of a cable and then connected with a mating connector to thereby bring all the conductors of the cable into contact with mating terminals at once, an incomplete connected state of the cable 15 and the like can be effectively prevented. As a result, the main circuit board 12 and the players 14, 16, 18 can be more satisfactorily electrically connected.

The players 14, 16, 18 and the like of the audio unit described above are merely application examples of the present invention, and specific structures of the connectors C12, C14, C16, C18 or the connectors C22 of the cables 15, 17, 19 can be suitably changed without departing from the scope and spirit of the present invention.

For example, in the case that the cables 15, 17, 19 and the like have a huge number of conductors 2, the ends of the cables 15, 17, 19 may be split into three or more split pieces, the connectors C22 may be mounted on the respective splits pieces, and the mating connectors C12, C14, C16, C18 may be provided with a number of connection sections corresponding to the connectors C22.

In this embodiment, the cables 15, 17, 19 are fixedly connected with the connectors C14, C16, C18 by inserting the ends (ends opposite from the side where the connectors C22 are mounted) of the respective cables 15, 17, 19 into the connectors C14, C16, C18 together with the sliders 32 through the insertion openings 30 provided at the rear surfaces of the connectors C14, C16, C18. However, the respective cables 15, 17, 19 may be, for example, directly secured to the circuit boards P by soldering or like means. In such a case, a structure for connecting the respective cables 15, 17, 19 such as the insertion openings 30 provided at the rear surfaces of the connectors C14, C16, C18 may be unnecessary.

Although the present invention is applied to an electrical connection structure of an audio unit installed in a vehicle in the foregoing embodiment, it is, of course, also applicable to an other electrical connection structure such as the one for an electrical unit.

Although the flat cables 15, 17, 19 are used as flat wire members in the foregoing embodiment, the flat wire members are not limited to flat cables. Ribbon wires, FPCs (flexible printed circuits) and the like may be used as such.

As described above, an inventive connector assembly for a flat wire member comprises a first connector for accommodating terminals, and a plurality of second connectors to be mounted on an end of a common flat wire member. The first connector includes a plurality of connecting portions individually connectable with the plurality of second connectors. The terminals are so accommodated in the first connector as to be directly brought into contact with conductors of the flat wire member connected with the first connector via the respective second connectors connected with the connecting portions.

Also, an inventive electrical connection structure for a flat wire member is provided with the inventive connector assembly. An end portion of the flat wire member is split into a plurality of split pieces arrayed in widthwise direction. The second connector is mounted on an end portion of each split piece. The respective second connectors are connected with the corresponding connecting portions of the first connector. Thereby, the conductors of the flat wire member are brought into contact with terminals accommodated in the first connector.

With the connector assembly and the electrical connection structure as above, an operation of connecting the flat wire member with a single connector (first connector) can be split into a plurality of operations. Accordingly, even in the case of connecting the flat wire member having a large number of conductors, an operation force required for one connecting operation can be reduced by splitting the connecting operation into a plurality of operations. As a result, the flat wire member can be easily and securely connected. Further, since the connector assembly itself has a simple construction in which the first connector is provided with a plurality of connecting portions for the second connectors, it is advantageous in view of costs.

The respective connecting portions may be provided while being offset at quite a different position. However, if one flat wire member to be connected is split into a plurality of pieces, it is preferable to arrange the respective connecting portions such that the respective conductors of the flat wire member connected with the first connector via the second connectors are arrayed in a row along widthwise direction.

Preferably, the first connector further includes an insertion portion which is provided at a side opposite from the respective connecting portions and into which an end portion of a flat wire member is insertable, and each terminal can be brought into contact with a corresponding conductor of the flat wire member connected with the first connector via the second connector and a corresponding conductor of the flat wire member inserted into the insertion portion. With this structure, the flat wire member connected with the first connector via the second connector and the flat wire member inserted into the insertion portion can be electrically connected with each other.

If the inventive connector assembly or the inventive electrical connection structure for the flat wire member is used, accordingly, the operation of connecting the common flat wire member with the single connector (first connector) can be split into a plurality of operations. Accordingly, even in the case of connecting the flat wire member having a large number of conductors, an operation force required for one connecting operation can be reduced by splitting the connecting operation into a plurality of operations. As a result, the flat wire member can be easily and securely connected.

This application is based on patent application No. 2000-382403 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A connector assembly comprising:

a flat wire member including conductors and an end portion split into a plurality of split pieces, a first connector including terminals accommodated therein; and a plurality of second connectors for respectively holding split pieces of the flat wire member in a state that portions of the conductors are exposed;

wherein the first connector includes a plurality of coupling portions to be respectively coupled with the plurality of second connectors, and the terminals are so accommodated in the first connector as to be brought into contact with the exposed portions of conductors of the flat wire member when the second connectors are respectively coupled with the coupling portions, wherein the coupling portions of the first connector are arranged on one side of the first connector side by side in widthwise direction of the flat wire member;

wherein the first connector further includes an insertion portion which is provided at a side opposite from the side where the coupling portions are arranged and which receives an end portion of a second flat wire member, with each terminal being brought into contact with a corresponding conductor of the second flat wire member to connect the conductor of the second flat wire member with a corresponding conductor of the flat wire member held by the second connectors.

2. A connector assembly according to claim 1, wherein the first connector includes a female housing formed with a plurality of cavities to respectively receive the split ends of the flat wire member held by the second connectors, and the terminals are accommodated in the cavities.

3. A connector assembly according to claim 1, wherein each of the second connectors includes a holder for holding the split end of the flat wire member and a housing for retaining the split end on the holder with portions of conductors of the flat wire member being exposed of the housing to be brought into contact with the corresponding terminals of the first connector.

4. A connector assembly according to claim 1, wherein the terminals of the first connector are connected with a circuit on a circuit board or a second flat wire member.

* * * * *